United States Patent [19]

Holtz et al.

[11] 4,059,414

[45] Nov. 22, 1977

[54] ASHLESS FUEL DETERGENT ADDITIVES

[75] Inventors: Hans D. Holtz; Benedict R. Bonazza, both of Bartlesville, Okla.

[73] Assignee: Phillips Petroleum Company, Bartlesville, Okla.

[21] Appl. No.: 691,118

[22] Filed: May 28, 1976

[51] Int. Cl.[2] ..... C10L 1/24

[52] U.S. Cl. ..... 44/58; 44/66; 44/71; 252/47.5

[58] Field of Search ..... 260/401; 252/34, 47.5; 44/72, 66, 71, 58

[56] References Cited

U.S. PATENT DOCUMENTS

| | | | |
|---|---|---|---|
| 2,305,083 | 12/1942 | Jayne, Jr. et al. | 260/401 |
| 2,312,414 | 3/1943 | Jayne, Jr. et al. | 260/401 |
| 2,355,503 | 8/1944 | Bertsch | 260/401 |
| 2,758,086 | 8/1956 | Stuart et al. | 44/72 |
| 3,005,847 | 10/1961 | Bray | 44/72 |
| 3,891,689 | 6/1975 | Pryce | 260/401 |

*Primary Examiner*—Daniel E. Wyman
*Assistant Examiner*—Mrs. Y. Harris-Smith

[57] ABSTRACT

A long chain monocarboxylic acid is reacted with a trialkanolamine to produce an ester and this ester is then treated with sulfonic acid to produce a sulfonate to provide compounds which are suitable as ashless detergent additives and the method for producing these compounds are provided. In a preferred embodiment the ashless fuel detergent additives are combined with hydrocarbons suitable as fuel in an internal combustion engine to provide ashless fuel and lubricant detergent compositions.

4 Claims, No Drawings

ASHLESS FUEL DETERGENT ADDITIVES

BACKGROUND OF THE INVENTION

This invention relates to additives for hydrocarbons suitable as fuel or lubricant in an internal combustion engine. In one of its aspects this invention relates to detergent additives for hydrocarbon fuels and lubricants. In another of its aspects this invention relates to ashless fuel detergent additives for use in hydrocarbon fuel in internal combustion engines. In yet another aspect of the invention it relates to compounds containing a plurality of different functional moieties combining to produce superior ashless fuel detergent qualities.

With the advent of pollution standards for automobile exhausts it has become important that fuel additives not contain metal ions which tend to poison the catalyst in automotive engine exhaust converter systems. It is well known that amide, sulfonate, and amine functional groups can provide engine protection as fuel and lubricant additives. Up until now, however, additive packages have been made up of mixtures of several different compounds such as amides formed by the reaction of dicarboxylic acid with alkylene polyamines, amine salts of sulfonic acids or reaction products of a polyamine and a petroleum sulfonic acid. In this invention multiple detergent functionalities are combined into a single molecule by combining sulfonate and amine functionalities together with long hydrocarbon chains which enhance solubility in fuels and lubricants.

It is therefore an object of this invention to provide multiple detergent functionalities for internal combustion engine fuels and lubricants in a single molecule. It is another object of this invention to provide a method for producing ashless fuel and lubricant detergent additives comprising multiple functionalities in a single molecule. It is still another object of this invention to provide an ashless detergent fuel composition combining an ashless fuel detergent additive with a hdyrocarbon suitable for use as fuel in an internal combustion engine.

Other aspects, objects and the various advantages of this invention will become apparent upon reading the specification and the appended claims.

STATEMENT OF THE INVENTION

A method for producing an ashless fuel detergent additive for an internal combustion engine for combining multiple detergent functionalities in a single molecule is provided by (1) reacting a long chain monocarboxylic acid with a trialkanolamine to produce an ester and (2) further reacting the ester produced with sulfonic acid to produce a sulfonated product.

A compound suitable as an ashless fuel detergent additive for an internal combustion engine is provided which is a compound prepared by reacting a sulfonic acid with the product obtained from the reaction of a long chain monocarboxylic acid and a trialkanolamine with the product containing at least one equivalent of both carboxylic acid and sulfonic acid in each molecule of the final product.

A composition suitable as an ashless, detergent fuel for internal combustion engines is also provided by combining an effective amount of the ahsless fuel detergent additive of this invention with a hydrocarbon or hydrocarbon mixture suitable for use as fuel in an internal combustion engine. This embodiment of the invention can also be stated as a method for reducing engine deposits in internal combustion engines by adding to a hydrocarbon fuel other compounds prepared by this invention in an amount effective as an ashless fuel detergent.

The additives of this invention are produced by reacting sequentially a trialkanolamine with a long chain monocarboxylic acid to form an ester. This product, which need not be recovered from the reaction mixture, is then treated with a sulfonic acid or mixture of sulfonic acids to form a sulfonated product.

The reaction sequence can be characterized as follows:

$$N(R-OH)_3 + 3R'COOH \longrightarrow N(R-O\underset{\underset{O}{\|}}{C}-R')_3 + 3H_2O$$

$$N(R-O\underset{\underset{O}{\|}}{C}R')_3 + R''SO_3H \longrightarrow R''SO_3^- {}^+NH(RO\underset{\underset{O}{\|}}{C}-R')_3$$

The R of the alkanolamine, represented above by the formula $N(R—OH)_3$, can be an alkylene radical of 2–10 carbon atoms including straight or branched aliphatic or cycloparaffinic radicals. Representative trialkanolamines include: triethanolamine, tripropanolamine, trihexanolamine, triisobutanolamine, tricyclohexanolamine, tridecanolamine, and the like. Mixtures may be used also.

The R′ of the monocarboxylic acid represented above by the formula R′COOH, may be a straight chain or branched alkyl or arylalkyl radical having 10–30 carbon atoms.

Representative acids include: neodecanoic acid, stearic acid, isostearic acid, phenylstearic acid, naphthyldodecanoic acid, tall oil acids, corn oil acids, soya bean acids, etc. Some of these acids are mixtures of acids with different chain lengths or isomeric mixtures. All of them provided they have at least 10 carbon atoms are acceptable.

The R″ of the sulfonic acids, represented above by the formula $R''SO_3H$, may be alkyl or alkylaryl with 6–80 carbon atoms. The mixture of sulfonic acids resulting from treatment of various petroleum fractions with sulfonic acid known as "acid oil" or "mahogany acids" having molecular weight between 150 and 1000 are also acceptable either by themselves or with associated oil fractions. Individual acids are dodecylsulfonic acid, dodecylbenzenesulfonic acid, octadecylbenzenesulfonic acid, octadecylsulfonic acid, eicosylsulfonic acid, etc.

Typically, the first reaction is between the trialkanolamine and the monocarboxylic acid to form the triester. The reaction is usually carried out at a temperature between 100° and 200° C, preferably at reflux temperature of the mixture and atmospheric pressure in the presence of a hydrocarbon solvent such as toluene, xylene, mesitylene, hexane, heptane, kerosene, etc.

The treatment with sulfonic acid is generally carried out at room temperature and normal pressures. The product can be used as produced and requires no further purification.

The final product is a detergent fuel additive which is used at about 1–100 lb./1000 barrels of fuel to prevent harmful carburetor and intake system deposits. The fuel can be any hydrocarbon useful as an internal combustion engine fuel, preferably hydrocarbon mixtures used in commercial fuel blends.

The additives of this invention also are found to be useful with lubricant stocks, particularly solvent refined, paraffinic lubricant stock having a viscosity index of 100 or above and a Saybolt Viscosity at 210° F in the range of about 39 to about 100 SUS, preferably about 45 to about 75 SUS. Other additives commonly used in formulating lubricants, such as Viscosity Index improvers, antioxidants, and the like can be used in formulation with the additives of this invention without destroying the effectiveness of the additives.

PREPARATION OF THE ADDITIVES

EXAMPLE I

In a 3-neck round bottom flask, equipped with a Dean-Stark trap, condenser, magnetic stirrer and thermometer, 11.6 g (0.078 mole) of triethanolamine was heated with 66.6 g (0.234 mole) isostearic acid $HOOC(CH_2)_{14}CH(CH_3)_2$ and 15.7 g (.0825 mole) of toluene sulfonic acid esterification catalyst in 300 ml. toluene at 110° C. The reaction proceeded slowly and about 250 ml. of solvent was distilled away to raise the reflux temperature to about 135–140° C for about 6 hours. After the theoretical amount of water had been collected, the product was dissolved in 200 ml. toluene. Two hundred ml. of $Na_2CO_3$ (15 g/200 ml. $H_20$) was added to remove the sulfonic acid catalyst. The toluene layer was drawn off, washed several times with water, dried and filtered. The filtrate was subjected to single stage vacuum distillation at 60° C and 25 mm Hg. Fifty-nine g of product, the triisostearate of triethanolamine was recovered as sample 1.

EXAMPLE II

Part of the product of Example I (16.92 g) was dissolved in 75 ml. toluene and allowed to react with 5.82 g dodecylbenzenesulfonic acid (mole ratio 1:1) at room temperature with stirring. The solvent was distilled to recover the amine salt, $$C_{12}\phi-SO_3^{-}\,{}^{+}NH[CH_2CH_2O-\underset{\underset{O}{\|}}{C}(CH_2)_{14}CH(CH_3)_2]_3$$

as sample 2.

EXAMPLE III

In a flask equipped as in Example I, 18.6 g (0.125 moles) triethanolamine, 43 g neodecanoic acid (0.250 moles) and 20 ml. xylene were refluxed at 185° C for 18.5 hours. Then 45 g (0.125 moles) phenylstearic acid was added and the mixture was refluxed at 160° C for 3½ hours. This product was the dineodecanoate-monophenylstearate of triethanolamine.

EXAMPLE IV

A run similar to Example III was made using 18.6 (0.125 moles) triethanolamine, 21.5 g neodecanoic acid (0.125 moles) in 24 ml. xylene, followed by 90.0 g (0.250 moles) phenylstearic acid. Reflux temperature was 180°–190° C initially for 8 hours and after addition of the phenylstearic acid reflux was continued at 160° C for 11 hours. The product was diphenylstearate-mononeodecanoate of triethanolamine.

EXAMPLE V

Part of the product of Example III (0.0625 moles) was allowed to react with 0.0562 moles of dodecylbenzenesulfonic acid in toluene solvent at room temperature with stirring. The product was the amine salt of the product of Example III as sample 3.

Similarly, part of the product of Example I was treated to prepare sulfonated diphenylstearate-mononeodecanoate of triethanolamine as sample 4.

EXAMPLE VI

The procedure in Example III was followed by reacting 6 g triethanolamine (0.04 moles) with 33.8 g tall oil acid (0.12 moles) (Arizona Chemical Co.) to form tall oil acid triesters of triethanolamine. The product was treated with 13.1 g (0.04 moles) of dodecylbenzenesulfonic acid to form the sulfonated amine salt of the ester, sulfonated tall oil ester of triethanolamine as sample 5.

EXAMPLE VII

In the flask described in Example I, 14.9 g triethanolamine (0.1 mole) was heated and a mixture of 36 g phenylstearic acid (0.1 mole) and 17.2 g neodecanoic acid (0.1 mole) in 40 ml. xylene was added dropwise and refluxed until 3.0 g water had been collected. Then 7.3 g (0.050 mole) adipic acid was added and refluxing continued until 2 ml. more water had been collected (about 8 hours). The product recovered was a mixed ester of triethanolamine containing three acids, sample 6. The compound does not fall within the scope of the invention.

The samples prepared in Examples I, II, V, VI, and VII were subjected to a series of tests for (a) gum deposits as determined by Phillips Carburetor Cleanliness Test; (b) detergency efficiency by thin layer chromatograph (TLC) rated 4–10, 10 best; (c) heat stability by measuring the weight of gum deposits, and (d) water tolerance test, ASTM D 1094–72. The test results are summarized below.

| Sample | (a) % Carburetor Deposit Reduction | (b) TLC | (c) Wt. of Deposit mg. | (d) Water Tolerance P or F |
|---|---|---|---|---|
| 1 | 0 | 4 | 0 | P |
| 2 | 63 | 8 | 0.3 | P |
| 3 | 19 | 9 | 0.3 | P |
| 4 | 29 | 8 | 0.2 | P |
| 5 | 40 | 8 | not run | not run |
| 6 | 27 | 4 | 1.4 | not run |

The data show that the triester of isostearic acid and triethanolamine. (Sample 1), is not an effective fuel additive, failing to reduce engine carburetor deposits and having low detergency rating. On the other hand the amine salt ester, (Sample 2), after treatment with dodecylbenzenesulfonic acid, gave good results in all tests. Sample 6, which is outside the scope of the invention, while it reduced engine deposits, apparently had a low detergency rating. All of the dodecylbenzenesulfonic acid treated samples gave good results in the tests. The amine salts derivatives of the fatty acid triesters of triethanolamine with sulfonic acids are effective detergent fuel and lubricant additives.

In the "Phillips Carburetor Cleanliness Test" to which the samples were subjected the additive was added to the hydrocarbon fuel in the amount of 10 lbs. of additive per 1000 barrels of hydrocarbon fuel. In the test a premium base unleaded gasoline without additive as a control and with various additives for test purposes was used to power a 170 CID 6-cyclinder Falcon engine. The engine was run for 23 hours at 1800 rpm and 11.4 bhp with continuous, non-cyclic operation. About 0.5 cubic feet per minute ambient air was introduced through PCV valve below the carburetor and 3.2 cubic feet per minute of exhaust gas was recirculated unfiltered through the carburetor throttle bore. Intake air was filtered through the standard filter element. An SAE 10W—40 motor oil was used as with the oil sump temperature maintained at 216 plus −4° F. The temperature of coolant out was maintained at 196° plus −5° F and the intake air temperature was varied to control the temperature above the carburetor sleeve at 150° plus −2° F. The fuel flow was maintained at about 1.5 gallons per hour with the air/fuel ratio checked periodically but not controlled and the intake manifold vacuum recorded but not controlled.

The performance of a fuel or additive in this test was evaluated on the basis of deposits formed on a removable aluminum sleeve in the carburetor throat. Three or four differential weights were obtained between the weight of the sleeve at the start of the test and the weights after the test: (1) unwashed, and (2) n-heptane washed. Visual ratings of deposits were not used in the evaluation. The results of the evaluation of the control and test runs are tabulated above in (a).

We claim:

1. A method for reducing engine deposits in an internal combustion engine comprising the addition to the hydrocarbon fuel for the engine of a detergent fuel additive prepared by reacting (a) a sulfonic acid represented by the formula $R''SO_3H$ where R'' is alkyl or alkylaryl having 6–80 carbon atoms in the molecule with (b) the product of the reaction of (1) a long chain monocarboxylic acid having the general formula R'COOH in which R' is a straight or branched chain alkyl or arylalkyl radical having 10–30 carbon atoms and (2) a trialkanolamine represented by the generic formula $N(R\text{-}OH)_3$ wherein R is an alkylene radical having 2–10 carbon atoms, said ashless fuel detergent being added in an amount effective to reduce engine deposits and using said hydrocarbon fuel with ashless fuel detergent additive as fuel in an internal combustion engine.

2. A method of claim 1 wherein said ashless fuel detergent is present in the range of about 1 to about 100 lb./1000 barrels of fuel.

3. A method of claim 1 wherein said monocarboxylic acid is neodecanoic acid and phenylstearic acid, said trialkanolamine is triethanolamine, and said sulfonic acid is dodecylbenzenesulfonic acid.

4. A method of claim 1 wherein said monocarboxylic acid is isostearic acid, said trialkanolamine is triethanolamine, and said sulfonic acid is dodecylbenzenesulfonic acid.

* * * * *